United States Patent [19]

Takase et al.

[11] Patent Number: 4,613,222

[45] Date of Patent: Sep. 23, 1986

[54] FILM ACCUMULATING DEVICE FOR DEVELOPING APPARATUS

[75] Inventors: Haruo Takase; Yoshimitsu Hanai, both of Odawara; Ryuzi Otomo, Tokyo, all of Japan

[73] Assignee: Fuji Photo Film Co., Ltd., Kanagawa, Japan

[21] Appl. No.: 712,050

[22] Filed: Mar. 15, 1985

[30] Foreign Application Priority Data

Mar. 15, 1984 [JP] Japan ..... 59-050261

[51] Int. Cl.[4] ..... G03D 3/13

[52] U.S. Cl. ..... 354/321; 354/339; 226/92

[58] Field of Search ..... 354/316, 320, 321, 322, 354/340, 344, 338, 339; 226/91, 92, 170, 171, 172, 196; 134/64 P; 352/235

[56] References Cited

U.S. PATENT DOCUMENTS

| | | | |
|---|---|---|---|
| 2,770,179 | 11/1956 | Dye et al. | 134/64 P |
| 3,172,115 | 3/1965 | Jeffee | 352/235 |
| 3,462,054 | 8/1969 | Foor | 352/235 |
| 3,587,436 | 6/1971 | Nast | 134/64 P |
| 4,035,809 | 8/1977 | Landers | 354/322 |
| 4,273,436 | 6/1981 | Drell | 354/344 |

*Primary Examiner*—A. A. Mathews

*Attorney, Agent, or Firm*—Sughrue, Mion, Zinn, Macpeak, and Seas

[57] ABSTRACT

A film accumulating device is connected to a developing apparatus in which a film is developed while being guided by a leader attached to the leading end of the film. The leader is guided obliquely upward until it abuts against guide means. Then, the leader moves upwardly while being guided by the guide means. Thereafter, one of the surfaces of the leader abuts against a hook, and the leading end thereof abuts against a stopper, whereby the upward movement is stopped. When the force for feeding out the leader has disappeared, the leader slightly lowers such as to be suspended from the hook. Thus, the film following the leader is deposited in a state wherein it is suspended from the leader.

21 Claims, 19 Drawing Figures

FILM ACCUMULATING DEVICE FOR DEVELOPING APPARATUS

BACKGROUND OF THE INVENTION

1. Field of the Invention

The present invention relates to a film accumulating device for a developing apparatus which is installed in the vicinity of the film outlet of the developing apparatus in a manner such as to accumulate leaders, together with developed films, in an aligned state.

2. Description of the Priot Art

Development of films, particularly color films, generally includes the steps of development, bleaching, fixing, rinsing, stabilization and drying. The number of steps required for development of color films is generally large as compared with that required for the development of monochrome films.

For this reason, these days, all the steps required for development of films are automatically carried out by means of a conveyor system. A typical automatic developing apparatus adopting a conveyor system has conventionally been arranged such that a film pulled out of a film cassette by a film feed device is passed by a conveyor belt through treating tanks containing the respective treating solutions, such as a developing solution, a bleaching solution, a fixing solution, rinsing water and a stabilizing solution, and is then passed through a dryer before being deposited in a predetermined box.

Further, the film feed device is arranged such that, when the film has been totally pulled out of the film cassette, a cutter is actuated such as to cut the trailing end of the film from the spool of the film cassette.

On the other hand, a conventional film accumulating device has such a structure that a multiplicity of films which have been subjected to the development process are successively dropped into a predetermined box. Owing to this structure, the image carrying surfaces of the films may be disadvantageously flawed, or each of the accumulated films may be electrostatically charged, and this may undesirably cause adhesion of dust on the films.

Further, since the films in the box are not in an aligned state, it is inconveniently necessary for an operator to take them out and arrange in order. In addition, in order to observe the finished state of each of the films in the box, it is necessary to take them out one by one.

SUMMARY OF THE INVENTION

In view of the above-described facts, it is a primary object of the present invention to provide a film accumulating device for a developing apparatus which allows developed films having been subjected to the development process to be automatically suspended from a predetermined hook successively in an aligned state.

To this end, according to the invention, there is provided a film accumulating device for a developing apparatus in which a guide is provided in the vicinity of the film outlet of the developing apparatus such as to upwardly guide a leader attached to the leading end of a film, and the leader moving upwardly is stopped at a predetermined position by means of a stopper, and further, one of the bores formed in the leader is allowed to engage a hook provided in the vicinity of the stopper by the weight and restoring force of the leader itself.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which.

DESCRIPTION OF THE PREFERRED EMBODIMENT

Figure 1:
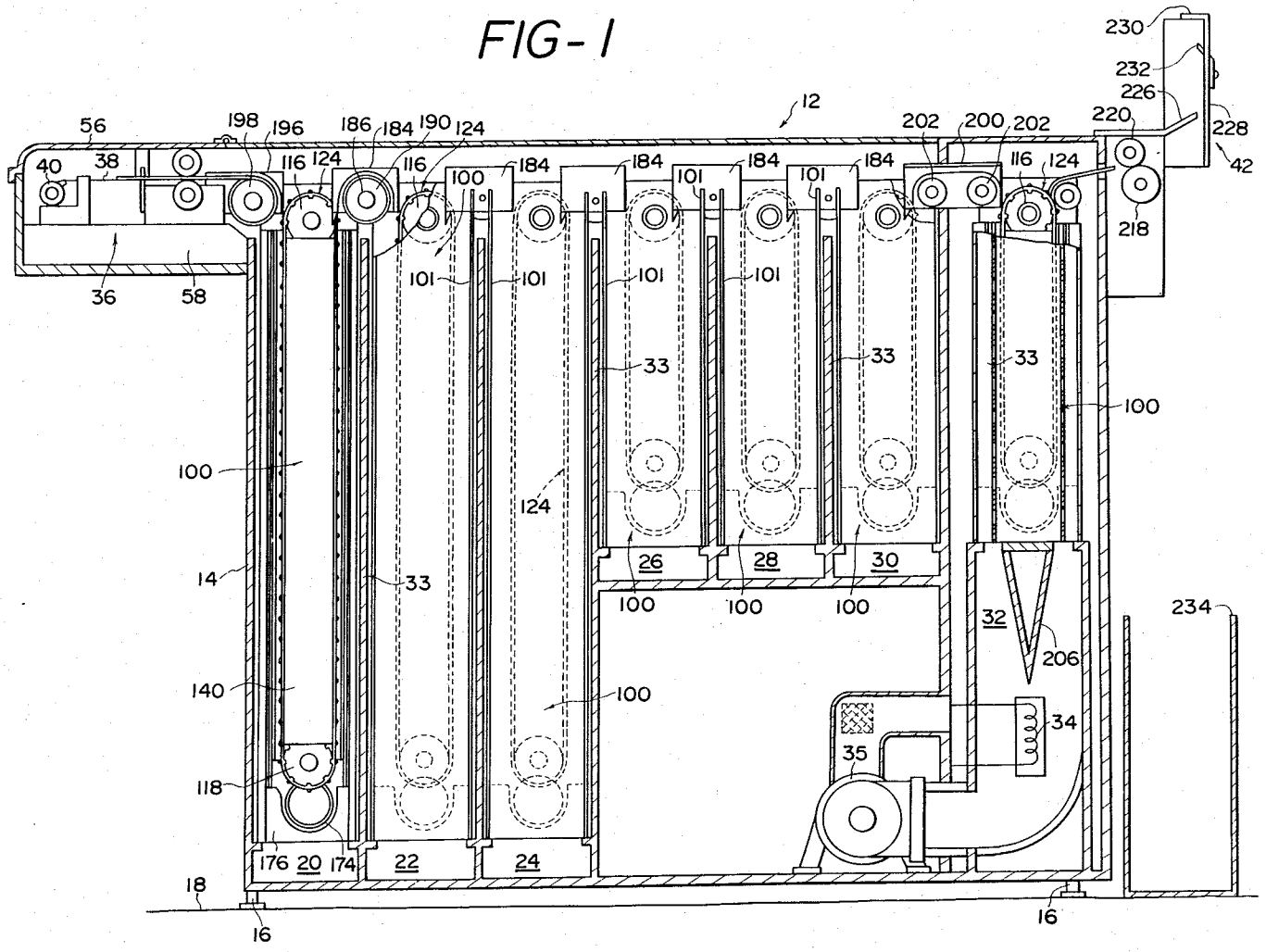
FIG. 1 is a sectional side elevational view of one example of a developing apparatus to which the film accumulating device according to the present invention is applied.

FIG. 1 is a sectional side elevational view of a developing apparatus 12 to which the present invention is applied. The developing apparatus 12 has its outside constituted by a frame 14 in such a manner that all the external light is shut off. The lower part of the frame 14 is supported on a floor 18 by a plurality of support legs 16.

The frame 14 is provided therein with a plurality of vertically extending treating tanks 20, 22, 24, 26, 28, 30 and 32 in series. The adjacent treating tanks are partitioned from each other by vertical walls 33. The treating tank 20 is filled with a developing solution; the treating tank 22 with a bleaching solution; the treating tank 24 with a fixing solution; the treating tanks 26, 28 with rinsing water; and the treating tank 30 with a stabilizing solution. The treating tank 32, which serves as a drying chamber, has a heater 34 and a fan 35 which are disposed in the lower part thereof so that warm air is supplied to the upper part of the tank 32.

A film feed device 36 is disposed on one of the sides of the treating tank 20 which is closer to the inlet side (the left-hand side as viewed in FIG. 1) of the developing apparatus 12. The film feed device 36 is arranged such that films 38 which are to be developed are pulled out from associated film cassettes 40 and are fed to the treating tank 20. On the other hand, a film accumulating device 42 is disposed on one of the sides of the treating tank 32, namely, the side of the developing apparatus 12 which is opposite to the side thereof on which the film feed device 36 is disposed. The film accumulating device 42 is arranged such as to accumulate the films 38 which have passed through the developing process.

Figure 2:
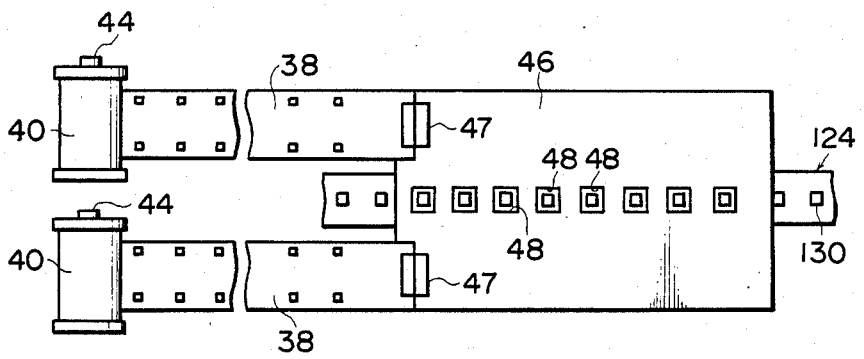
FIG. 2 is a plan view showing how a film is attached to a leader.

The films 38 are, as shown in FIG. 2, respectively housed in the film cassettes 40, being wound on respective spools 44. According to this embodiment, the leading ends of two films 38 unwound from the associated spools 44 are secured to a single leader 46 by strips of adhesive tape 47 or other similar bonding means. The leader 46 is constituted by a flexible synthetic resin sheet which is slightly higher in rigidity than the films 38. The leader 46 has square bores 48 serving as engagement bores which are longitudinally formed in a row in the center thereof at proper spacings. As the leader 46, for example, a sheet may be employed which includes a base made of PET (polyethylene terephthalate) and has a thickness of 250 $\mu$.

The film feed device 36 will be explained hereinunder in more detail with reference to FIGS. 3 and 4.

The film feed device 36 is installed in the upper part of the frame 14 on the inlet side (the left-hand side as viewed in FIG. 1) of the developing apparatus 12. The upper side of the film feed device 36 is covered by an openable cover 56. A base plate 58 is disposed in the frame 14 such as to extend in the conveying direction of the films 38. A pair of film holders 60 having an angled cross-section are installed in parallel on the base plate 58. The holders 60 are adapted to be slidable on a rail 62 laid in the film conveying direction. The holders 60 are normally biased by compression coil springs 64 toward the inlet (the left-hand side as viewed in FIG. 3).

In operation, with the leading ends of two films 38 connected to the leader 46. the film cassettes 40 are mounted on the holders 60 and fixed thereto (the fixing structure is not shown), and the leader 46 is inserted into the area between conveyor rollers 66, 67, whereby the films 38 are simultaneously conveyed in the direction of the arrow A. The upper conveyor roller 66 is a movable roller which is rotatably supported on the cover 56 such that, when the cover 56 is opened, the conveyor roller 66 is separated from the other roller 67.

Cutters 68 are installed between the holder 60 and the conveyor roller 66. Each cutter 68 has a sharp or thin edge and is supported at its proximal end by a support 72 through a pin 70 in the manner shown in FIG. 4. Further, a pin 74 is provided projecting from the outer surface of the support 72, and a torsion coil spring 76 is provided between the cutter 68 and the pin 74 in order to bias the cutter 68 such that the distal end thereof is normally at a lower position as viewed in FIG. 4.

The lower surface of the distal end of each cutter 68 is contacted by an actuating pin 80 projecting from a slot 78 formed in the support 72. The actuating pin 80 is adapted to be vertically moved within the slot 78 by a solenoid 82 (see FIG. 3) which is installed inside the support 72. Accordingly, when the actuating pin 80 is moved upwardly, the corresponding cutter 68 is pivoted against the biasing force of the torsion coil spring 76 in such a manner that the distal end thereof is moved in the direction (upwardly as viewed in FIG. 4) in which the film 38 can be cut. For explanatory convenience, the two cutters 68 in FIG. 4 are shown in different positions from each other: the left cutter 68 is in the state prior to cutting; the right cutter 68 is in the state after cutting. If two films have the same length, however, both the cutters 68 operate simultaneously.

Above each cutter 68, a guide 84 is installed for receiving and guiding the cutter 68. The guide 84 has its upper end secured to the inner surface of the cover 56. The guide 84 further has a cutter receiving guide groove 86 formed in the lower part thereof. A portion of the guide groove 86 near the opening thereof is gradually enlarged such as to define a divergent portion 86A, whereby the cutter 68 in an operative state can smoothly fit into the guide groove 86.

Figure 4:
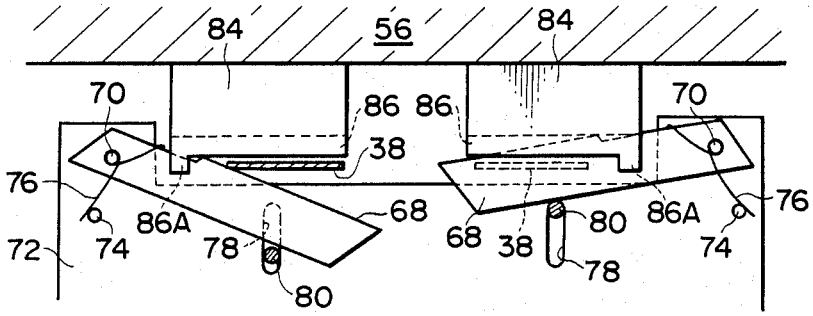
FIG. 4 is a sectional view taken along the line IV—IV of FIG. 3.

Further, as will be understood from an examination of the cutter 68 on the left-hand side as viewed in FIG. 4, a portion of the cutter 68 in the state before cutting is located within the guide groove 86. By virtue of these arrangements, even if the cutter 68 has a thin edge, it can reliably fit into the guide groove 86 when cutting the film, whereby it is possible to prevent any mistake in cutting.

Further, since the cutter 68 may have a thin edge, it is possible to employ an ordinary marketed cutter. It is, therefore, possible to remarkably reduce the costs of the cutter mechanism.

Figure 3:
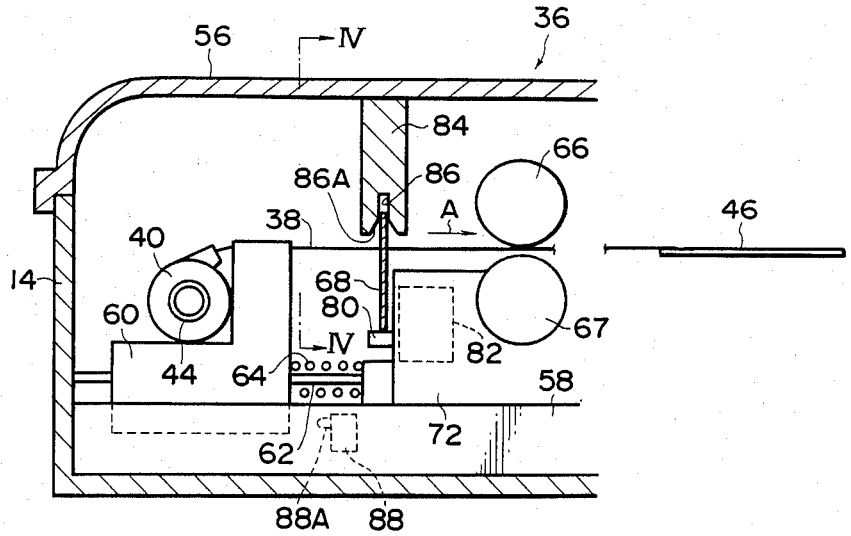
FIG. 3 is an enlarged view of a portion of the developing apparatus, which particularly shows a film feed device.

The base plate 58 has, as shown in FIG. 3, limit switches 88 disposed thereon in such a manner that their contactors 88A oppose the front end surface of the respective holders 60. The limit switches 88 are electrically connected to the solenoids 82. When each film 38 has been totally pulled out of the associated film cassette 40, the force applied in order to pull out the film 38 is transmitted to both the film cassette 40 and the holder 60. Thereupon, the holders 60 themselves are moved in the film feeding direction against the biasing force of the compression coil spring 64.

Accordingly, when the films 38 have been completey pulled out of the film cassette 40, the holders 60 are advanced to press the contactors 88A of the limit switches 88, whereby cutter actuating signals are delivered to the solenoids 82. More specifically, when the limit switches 88 detect the fact that the films 38 have been completely pulled out of the film cassettes 40, the cutters 68 are actuated such as to cut the trailing ends of the films 38 from the film cassettes 40. The films 38 after being cut off are fed to the corresponding developing line, together with the leader 46.

In each treating tank, a film conveyor unit 100 is mounted. The film conveyor unit 100 is arranged such that the film 38 first moves downwardly such as to be dipped in the treating solution contained in the corresponding tank and then turns upwardly at the bottom part of the tank such as to be conveyed out of the tank. The film conveyor unit 100 will be described hereinunder in detail with reference to FIGS. 5 to 8.

In the film conveyor unit 100, a pair of side plates 102 are disposed in opposing relation to each other, each side plate 102 having a bent portion 101 formed at both sides thereof. Between these side plates 102 are stretched a plurality of support rods 104, and both ends of each support rod 104 are secured to the corresponding side plates 102 by screws 106, whereby the distance between the side plates 102 is set.

Further, rotating shafts 108, 110 are rotatably supported through bearings 112, 114, respectively, near both ends of the side plates 102, that is, near the upper and lower ends thereof in an assembled state. Sprocket wheels 116, 118 which act as belt engaging wheels are secured to the respective central portions of the rotating shafts 108, 110 such as to rotate together with the shafts 108, 110. One of the ends of the rotating shaft 108 projects from the side plate 102, and a sprocket wheel 120 is secured to the distal portion of the projecting end of the rotating shaft 108. A chain 122 is engaged with the sprocket wheel 120 and is rotated by the driving force of a motor, not shown, thereby enabling the rotating shaft 108 and the sprocket wheel 116 to rotate.

Figure 10:
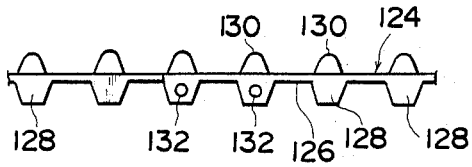
FIG. 10 is a side elevational view showing the ends of the timing belt in a connected state.

A timing belt 124, also shown in FIG. 10 in detail, is engaged with both the sprocket wheels 116, 118. The timing belt 124 is integrally molded from a synthetic resin. The timing belt 124 has a belt base 126 which has a small width and a small thickness. On one of the sides of the belt base 126 are formed a plurality of trapezoidal projections 128 serving as timing projections at equal spacings. On the other side of the belt base 126 are formed engagement projections 130 at equal spacings and at positions corresponding to the trapezoidal projections 128, the engagement projections 130 having a smaller width than that of the trapezoidal projections 128. The engagement projections 130 are engaged with the square bores 48 in the leader 46, whereby the leader 46 is driven along the timing belt 124.

The timing belt 124 has a predetermined length. Both ends thereof are connected together by a pair of connecting pins 132 in the manner shown in FIG. 10. This connecting structure will be explained in more detail. One end 124A of the timing belt 124 is formed by cutting both widthwise edges of the belt base 126 over a distance corresponding to the longitudinal length of a portion of the timing belt 124 which includes two or more engagement projections 130. The other end 124B of the timing belt 124 has in its widthwise center a rectangular notch 134 into which the end 124A is inserted and fitted. Thus, the ends 124A and 124B in combination constitute a connection.

The trapezoidal projections 128 formed at the end 124A and those at the end 124B have through-holes 136 and 138 respectively which are formed in the widthwise direction of the belt base 126 and which are to be located coaxially with each other when both the ends 124A, 124B are connected together. In consequence, when the end 124A is inserted into the notch 134 and the connecting pins 132 which act as connecting means are respectively inserted and secured in the through-holes 136, 138 by press fitting or other similar means, the timing belt 124 is connected at both its ends, thereby obtaining a looped timing belt 124 such as that shown in FIG. 8. Thus, it is possible to stretch the timing belt 124 between the sprocket wheels 116, 118 in such a manner that it can be rotated.

It is to be noted that a plurality of timing belts 124 can be connected together such as to form a single long loop in a manner similar to the above-described. For example, among the treating tanks shown in FIG. 1, the timing belt 124 in each of the treating tanks 20, 22, 24 may be constituted by seven belts which are continuously connected, and the timing belt 124 in each of the treating tanks 26, 28, 30, 32 may be constituted by four continuously connected belts.

In particular, according to this embodiment, the connecting portions at both ends of the timing belt 124 are connected together in such a manner that the connecting portions overlap each other over a distance corresponding to the longitudinal length of a portion of the timing belt 124 which includes two trapezoidal projections 128. For this reason, when the connection is curved at the respective outer peripheries of the sprocket wheels 116, 118, no acute bend is formed. The connection is, therefore, able to draw a smooth curve in a manner similar to that of an intermediate portion of the timing belt 124.

The connecting portions at both ends of the timing belt 124 may overlap each other over a distance corresponding to the longitudinal length of a portion of the belt 124 which includes three or more trapezoidal projections 128 rather than two as in the case of this embodiment.

Between the side plates 102, a support plate 140 is disposed extending between the sprocket wheels 116, 118 such as to oppose the inner peripheral surface of the timing belt 124. The support plate 140 is supported by the side plates 102 through the support rods 104 which are received through the support plate 140 at intermediate portions thereof, respectively.

The support plate 140 further has circular notches 142 which are respectively formed at both longitudinal ends thereof such as to partially receive the sprocket wheels 116, 118, respectively. In addition, a U-shaped groove 144 is formed on each of the side surfaces of the support plate 140 such as to extend over the whole longitudinal length of the side surface. This U-shaped groove 144 houses the trapezoidal projections 128 formed on the timing belt 124 in order to guide the timing belt 124 such that it is prevented from moving in the widthwise direction.

On the other hand, a pair of guide bars 146 serving as guide means are provided such as to interpose the timing belt 124 therebetween. More specifically, each guide bar 146 is disposed on the side of the timing belt 124 which is remote from the support plate 140 such as to oppose the outer peripheral straight portion of the timing belt 124. The guide bars 146 are respectively secured to a pair of cover plates 148 which are stretched between the side plates 102.

Each guide bar 146 has a U-shaped groove 150 formed in the surface thereof which opposes the timing belt 122. The U-shaped groove 150 has a width slightly larger than the width of the engagement projections 130 formed on the timing belt 124, thus serving as a passage for the engagement projections 130 when the timing belt 124 is moved.

Further, the guide bar 146 is disposed such as to form a slight gap between the same and the surface of the belt base 126. More specifically, the gap is a space for allowing passage of the leader 46 when being pulled by the timing belt 124. Thus, the guide bar 146 serves to retain the leader 46 between the same and the timing belt 124 and to prevent disengagement between the engagement projections 130 and the square bores 52.

Figure 5:
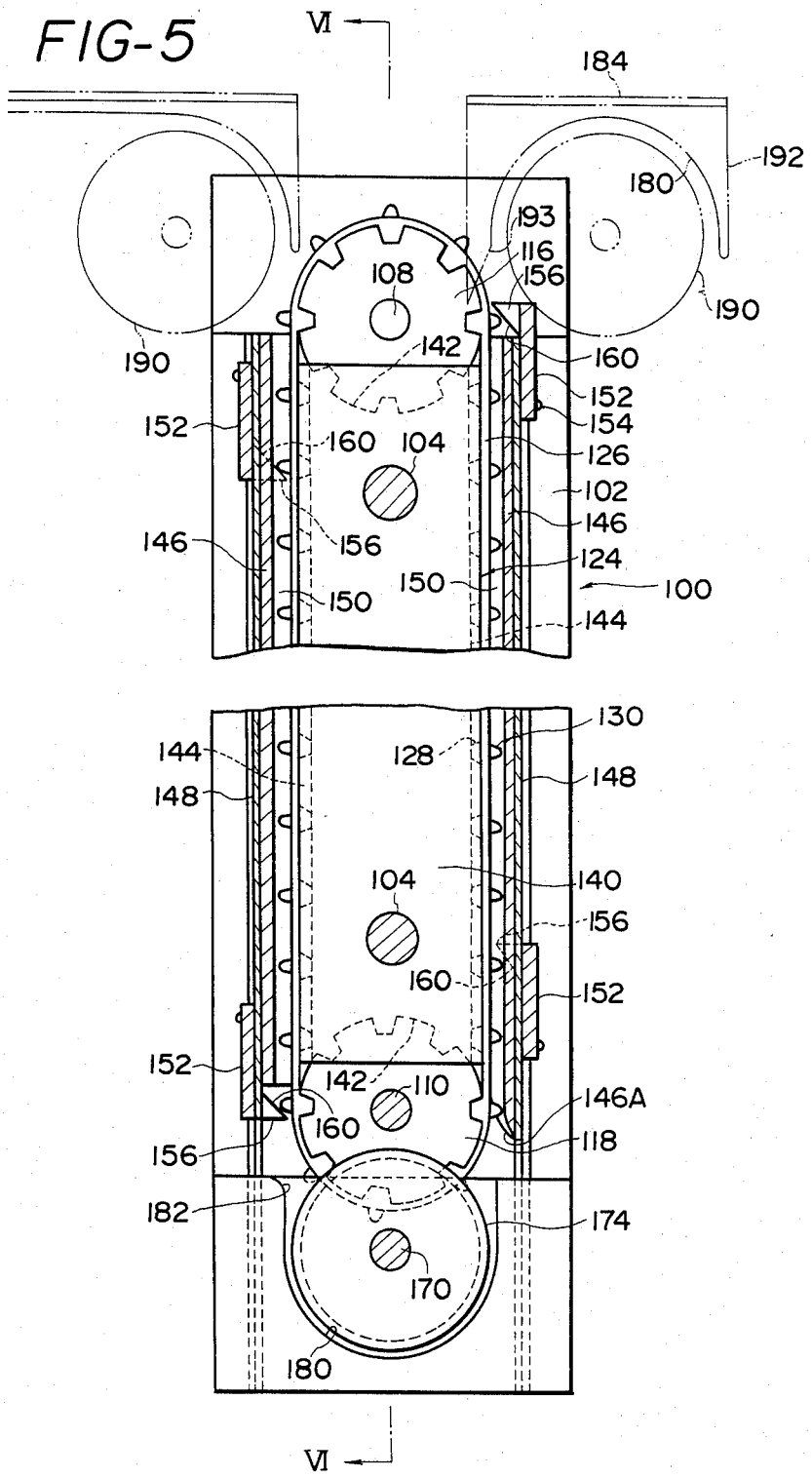
FIG. 5 is an enlarged sectional view of a film conveyor unit, which corresponds to a sectional view taken along the line V—V of FIG. 7.
Figure 6:
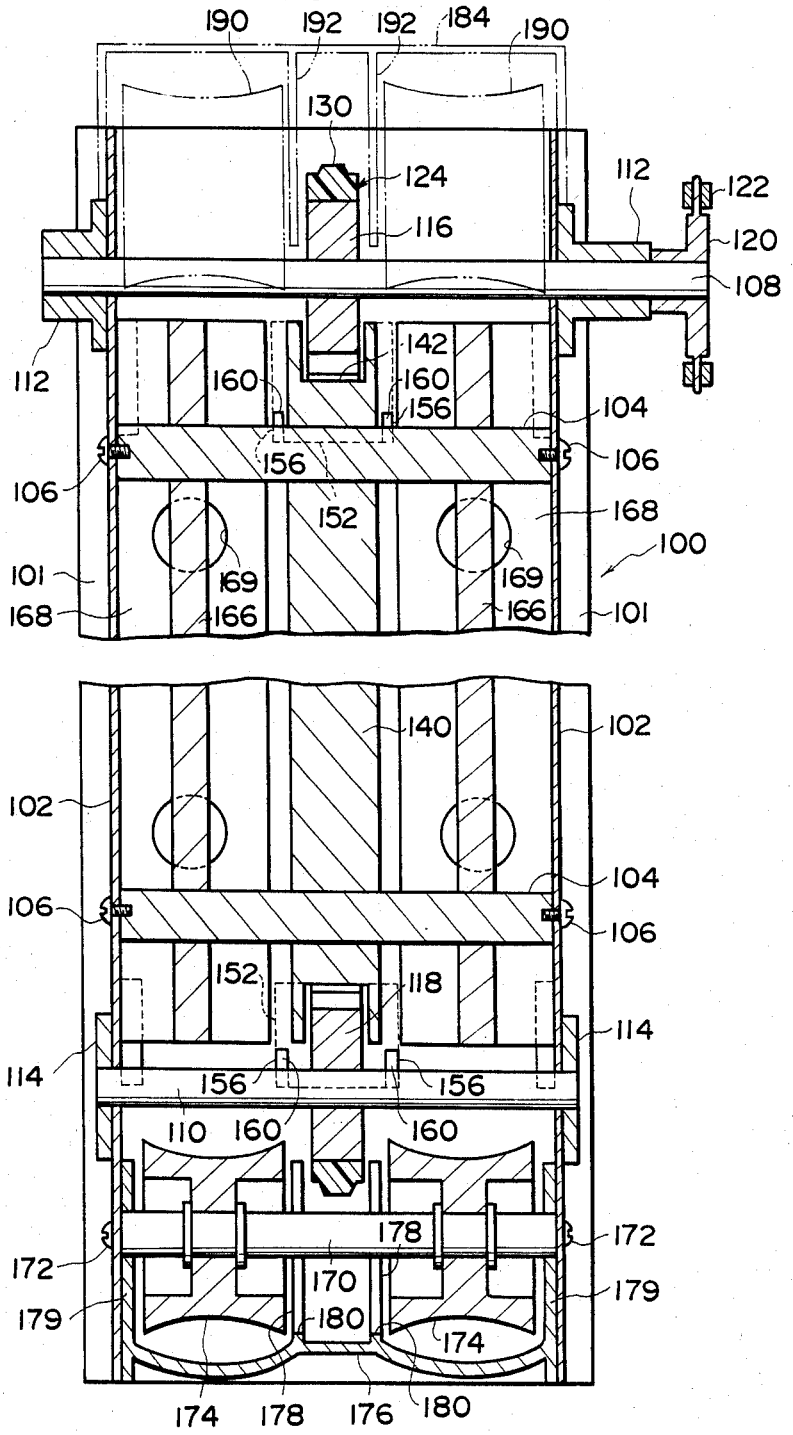
FIG. 6 is a sectional view taken along the line VI—VI of FIG. 5.
Figure 8:
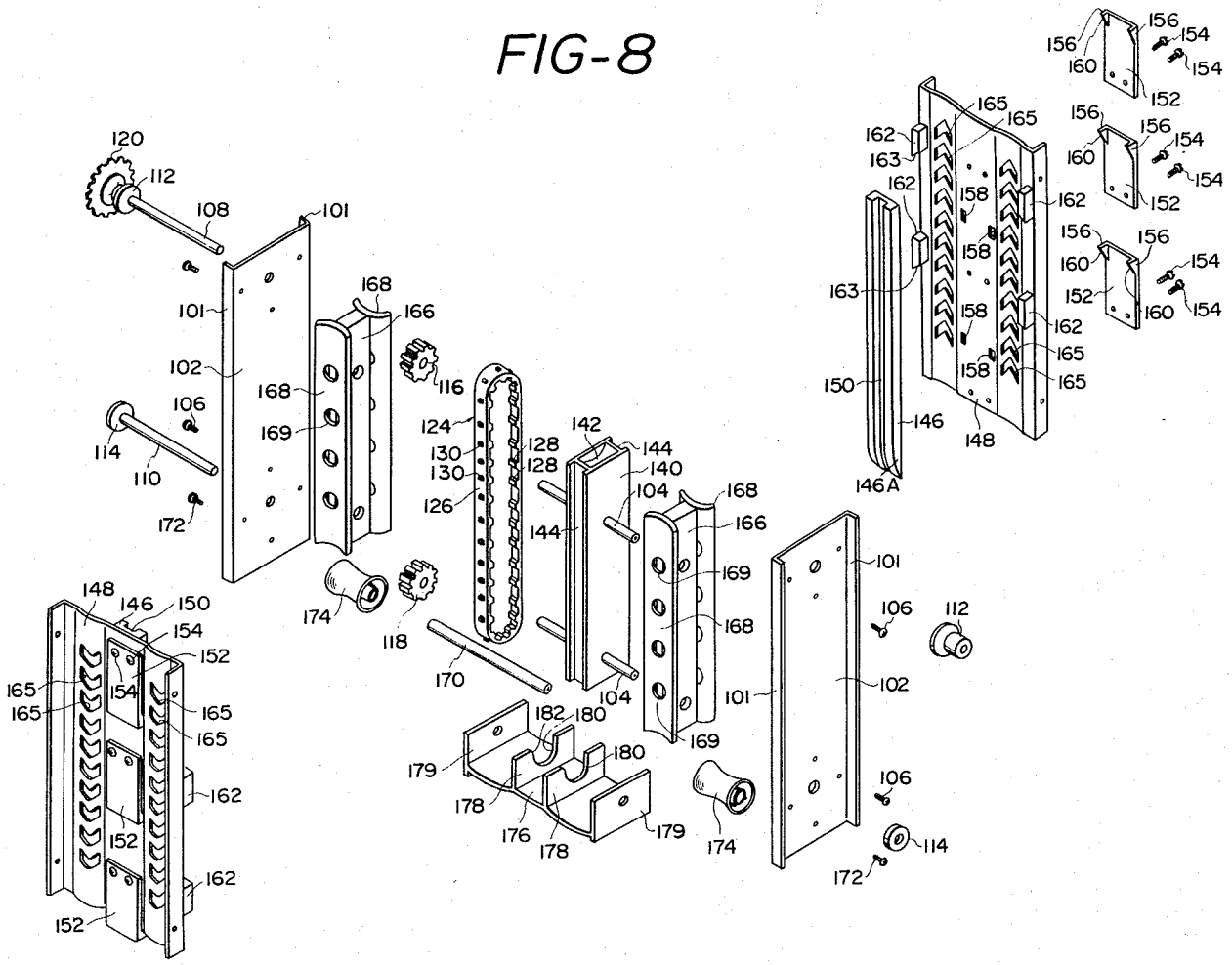
FIG. 8 is an exploded perspective view of the film conveyor unit.
Figure 9:
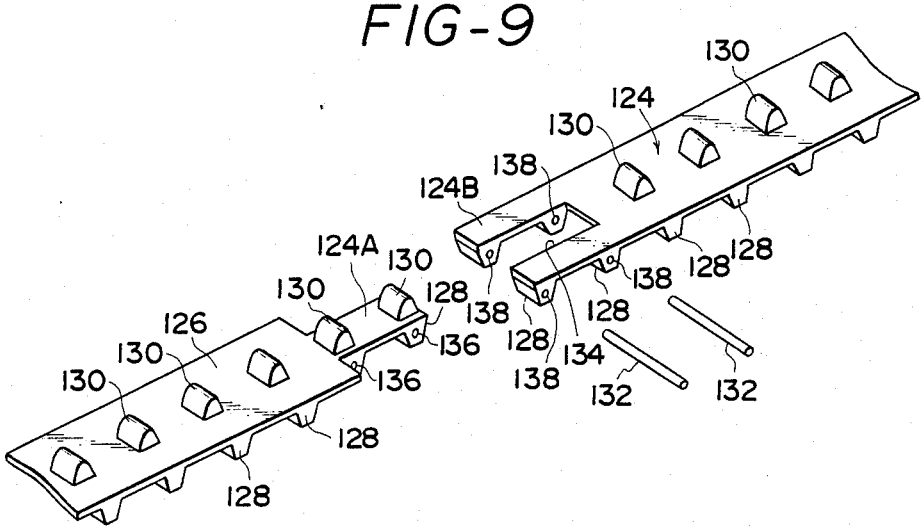
FIG. 9 is an exploded perspective view showing how both ends of a timing belt are connected together.

As shown in FIGS. 5 and 8, one of the guide bars 146 has its lower end gradually decreased in wall thickness such as to form a circular guide portion 146A in order to smoothly guide the leader 46 into the area between the guide bar 146 and the timing belt 124 at the portion of the timing belt 124 at which it is changed over from a curved state to a straight state.

Three flexible plates 152 serving as a film meandering preventing mechanism are secured in a vertical row to the outside of each cover plate 148, that is, on the side thereof which is remote from the timing belt 124. Each flexible plate 152 is constituted by a thin-walled plate made of a synthetic resin, as shown in detail in FIG. 8. The flexible plate 152 is secured at one end thereof to the corresponding cover plate 148 by screws 154. The screws 154 are employed to secure the guide bar 146 to the cover plate 148 simultaneously with the fixing of the flexible plate 152.

Figure 7:
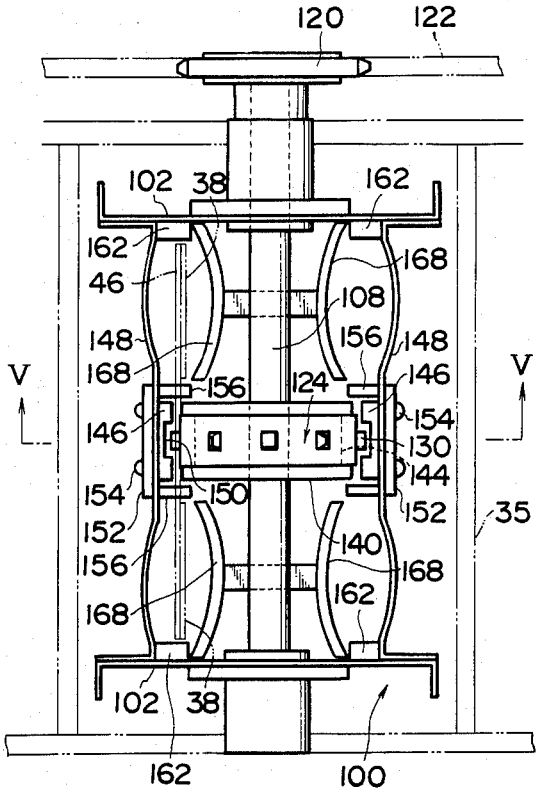
FIG. 7 is a plan view of the film conveyor unit shown in FIG. 5.

Each flexible plate 152 is provided at the other end thereof with a pair of triangular meandering preventing pawls 156 which are integrally molded with the flexible plate 152. These pawls 156 project toward the timing belt 124 in the following manner: One pair of the pawls 156 extend beyond the upper end of one of the cover plates 148; another pair of pawls 156 extend beyond the lower end of the other cover plate 148; and the other pawls 156 respectively pass through rectangular through-holes 158 formed in the cover plates 148, such that the pawls 156 project toward the timing belt 124. The pawls 156 project such as to oppose one of the side edges of the film 38 being conveyed, as shown in FIG. 7, thus serving as limiting means for preventing the moving film 38 from meandering.

Each pawl 156 is disposed such that its slanting surface 160 is inclined with respect to the moving direction of the leader 46 which is fed by the timing belt 124, whereby, when the leader 46 being moved abuts against the slanting surfaces 160 and bends the flexible plate 152, the pawls 156 are pushed out of the moving locus of the leader 46. Accordingly, as it moves, the leader 46 expels the pawls 156 from its moving locus, and, when the leader 46 has passed over, the pawls 156 are allowed to project again from the inner surface of the associated cover plate 148, whereby it is possible to properly guide the side edge of the film 38 as it is pulled by the leader 46. In consequence, even when a plurality of films 38 are guided by the leader 46 as in the case of FIG. 2, it is possible to make the pawls 156 correspond to respective side edges of the films 38.

Further, limiting blocks 162 are secured to portions of each cover plate 148 in the vicinity of both side edges thereof such as to correspond to the flexible plates 152 secured to the cover plate 148. Each limiting block 162 faces the other side edge of the film 38 being moved. Thus, the limiting blocks 162 also serve to prevent meandering of the film 38. Each limiting block 162 has a slanting surface 163 which is formed such as to face the leader 46 being advanced in order to allow the film 38 to be smoothly guided into the area between the limiting block 162 and the corresponding flexible plate 152.

It is to be noted that each cover plate 148 is formed with a plurality of through-holes 165 which serve to allow the treating solution concerned to circulate. Each through-hole 165 is formed in the shape of a 'V' the convergent angle of which points in the advancing direction of the film 38, whereby the film 38 is prevented from contacting the through-holes 165 which would undesirably obstruct the movement of the film 38 if such contact occurred.

Support brackets 166 are respectively secured to the support rods 104 which project from both sides of the support plate 140 disposed inside the timing belt 124. Limiting plates 168 each having a circular cross-section are respectively secured to both sides of each support bracket 166. These limiting plates 168 prevent the films 38 being moved from bending unnecessarily in a corrugated manner. Each limiting plate 168 has a plurality of circular bores 169 so as to promote the circulation of the treating solution concerned.

Between the side plates 102, a support shaft 170 is stretched below the sprocket wheel 118 and in parallel to the rotating shaft 110. The support shaft 170 is secured to the side plates 102 by screws 172. A pair of rollers 174 for turning the leader 46 are rotatably mounted on the support shaft 170.

These rollers 174 have a circular cross-section. More specifically, the outside diameter of each roller 174 is smallest at the axial center thereof and is gradually increased toward both axial ends thereof.

Moreover, a bracket 176 for turning the leader 46 is stretched between the side plates 102 such as to correspond to these rollers 174. Two pairs of vertical walls 178, 179 project from the bracket 176 such that the walls 178, 179 respectively correspond to both axial ends of each roller 74. Each vertical wall 178 is, as shown in detail in FIG. 5, formed with a circular guide portion 180 having an inside diameter slightly larger than the outside diameter of the roller 174. The circular guide portions 180 are open toward the sprocket wheel 118. Thus, the space defined between the guide portions 180 and the rollers 174 forms a U-shaped leader turning guide means. One of the ends of this U-shaped leader turning guide means is disposed on the extension of one of the straight portions of the timing belt 124 such as to form a leader inlet; the other end is disposed on the extension of the other straight portion of the timing belt 124 such as to form a leader outlet.

Accordingly, the leader 46 downwardly guided by the engagement with the engagement projections 130 of the timing belt 124 is released from the retainment by one of the guide bars 146 and the timing belt 124 at its turning position at which it is engaged with the sprocket wheel 118. Accordingly, the leader 46 advances straight downwardly independently of the bending of the timing belt 124 for effecting turning and enters the turning area defined between the circular guide portions 180 and the rollers 174. The leader 46 having entered the turning area makes a turn around the rollers 174 along the guide portions 180 and then re-engages the engagement projections 130 of the timing belt 124 turned by the sprocket wheel 118 such as to be moved upwardly. The leader 46 is smoothly engaged with the engagement projections 130 of the timing belt 124 by virtue of the circular guide portions 146 of the guide bar 146 whereby it can be moved upwardly.

Thus, it is possible to cope with an increase in the pitch of the engagement projections 130 at the position of the timing belt 124 at which it is turned by the sprocket wheel 118. This point will be explained hereinunder in more detail. The timing belt 124 is designed such that a plurality of trapezoidal projections 128 are accurately meshed with the sprocket wheels 116, 118. Therefore, at the straight portions of the timing belt 124, the pitch between a plurality of trapezoidal projections 128 is equal to the pitch between a plurality of engagement projections 130. At the bent portions of the belt 124, however, the pitch between the engagement projections 130 becomes larger than the pitch between the trapezoidal projections 128 by an amount corresponding to the wall thickness of the belt base 126, which fact makes it impossible for the square bores 48 in the leader 46 to properly engage the engagement projections 130. In order to cope with such dimensional change, according to this embodiment, the leader 46 is disengaged from the timing belt 124 at the bent portion of the belt 124 and is re-engaged with the belt 124 after making a turn.

It is to be noted that each circular guide portion 180 has an introducing circular portion 182 formed at its inlet portion such as to make it possible for the leader 46 to easily enter the turning area between each guide portion 180 and the corresponding roller 174.

Figure 11:
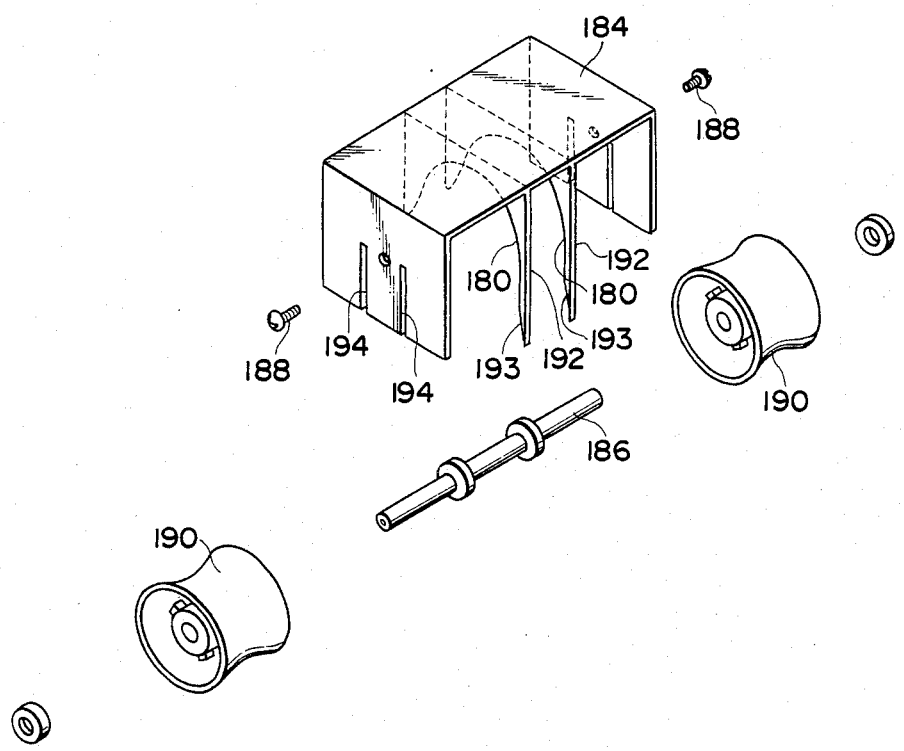
FIG. 11 is an exploded perspective view of a support bracket and rollers in combination constituting means for turning the leader.

As shown in FIG. 1, a support bracket 184 (also shown in FIG. 11) is secured to the respective upper ends of the adjacent units of a plurality of film conveyor units 100. The support bracket 184 is formed by bending a sheet material into a U-shape. A support shaft 186 is stretched between both leg portions of the bracket 184 and is secured thereto by screws 188. By this support shaft 186 are rotatably supported rollers 190 for turning the leader 46 which have the same configuration as that of the rollers 174 which are mounted at the respective lower portions of the film conveyor units 100.

Further, a pair of vertical walls 192 project from the center of the support bracket 184 at a proper spacing. Each vertical wall 192 has a circular guide portion 180 similar to that of each of the vertical walls 178 mounted in the respective lower portions of the film conveyor units 100. One of the ends of each vertical wall 192 forms a slanting guide portion 193. Moreover, the support bracket 184 has a pair of parallel slit-like notches 194 formed in each of the leg portions thereof such as to interpose the support shaft 186 therebetween.

Accordingly, when the support bracket 184 is installed in such a manner that the notches 194 are respectively engaged with the side plates 102 of the adjacent film conveyor units 100 as shown in FIG. 1, the rollers 190 are disposed between the respective upper portions of the adjacent film conveyor units 100. Thus, in the support bracket 184, the leader 46 is disengaged from the timing belt 124 and turned along the rollers 190 and is then transferred to the subsequent film conveyor unit 100 in a manner similar to that of the turning guide means mounted in the lower portion of each film conveyor unit 100. In this case, therefore, the turning guide means formed in the support bracket 194 has the leader inlet and outlet which are respectively disposed on the extensions of the straight portions of the timing belts 124 respectively provided in the adjacent treating tanks. In particular, as shown in FIG. 5, the slanting guide portion 193 of each vertical wall 192 extends into the moving locus of the timing belt 124 such as to correspond to a position on the extension of the upwardly moving straight portion of the timing belt 124, thus allowing the leader 46 to be smoothly transferred to the circular guide portion 180.

Between the upper end of the treating tank 20 and the film feed device 36, a support bracket 196 is disposed which is arranged such as to guide the leader 46 and the films 38, which are being fed horizontally, to the film conveyor unit 100 disposed in the treating tank 20 and to allow the leader 46 to engage the timing belt 124. The structure of this support bracket 196 is similar to that of the support bracket 184. Therefore, in the support bracket 196 also, rollers 198 for turning the leader 46 are rotatably supported.

A support bracket 200 similar to the above-described support bracket 184 is mounted between the teating tanks 30 and 32. The support bracket 200 is arranged such as to move the leader 46 and the films 38 from the treating tank 30 to the treating tank 32 by turning the leader 46 and the films 38. However, the distance between the treating tanks 30 and 32 is slightly larger than that between the other adjacent treating tanks. For this reason, in the support bracket 200, a pair of rollers 202 for turning the leader 46 are rotatably supported in such a manner that they are a proper distance apart from each other as viewed from the side of the support bracket 200, as shown in FIG. 1.

In addition, the film conveyor units 100 respectively disposed in the treating tanks 26, 28, 30 and 32 are designed such as to be smaller in the longitudinal or vertical dimension than the film conveyor units 100 in the other treating tanks.

In the treating tank 32, a separator 206 having an inverted triangular shape is provided directly below the film conveyor unit 100 disposed therein. The arangement is such that the warm air from the heater 34 sent by the fan 35 is branched off by the separator 206 such as to be blown into the area between the vertical wall 33 and one of the cover plates 148 of the film conveyor unit 100 and into the area between the frame 14 and the other cover plate 148, and the warm air is blown out toward the films 38 through the through-holes 165 formed in the cover plates 148, thereby effecting a drying treatment.

Figure 12:
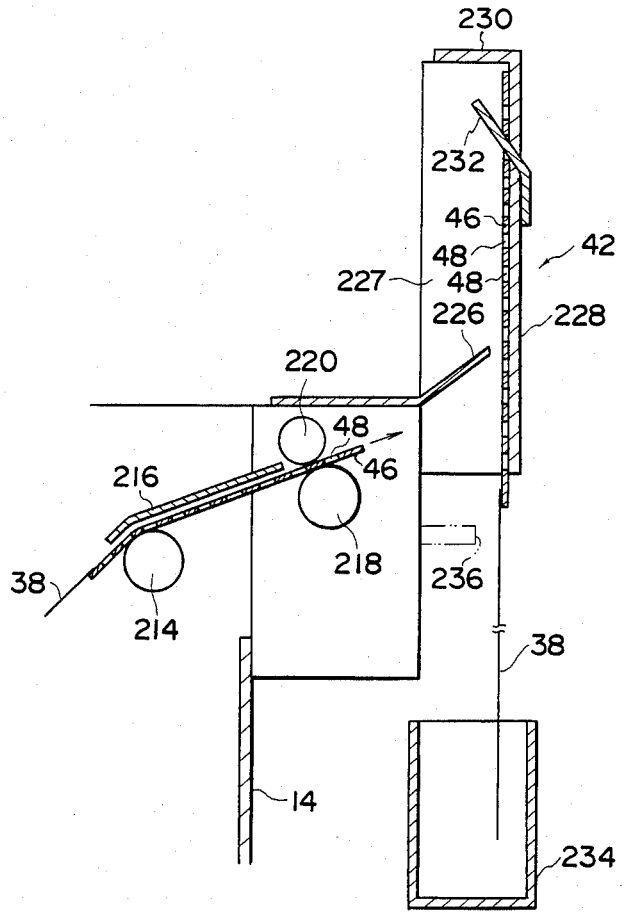
FIG. 12 is an enlarged sectional view of the film accumulating device ccording to the present invention.

The film accumulating device 42 is disposed adjacently to the treating tank 32. As shown in FIG. 12 in an enlarged manner, the film accumulating device 42 is provided with a guide roller 214 and a guide plate 216. The film accumulating device 42 is arranged such that the films 38, having been subjected to the developing process, are fed, together with the leader 46, into the area between the guide roller 214 and the guide plate 216.

The leader 46 and the films 38 guided by the guide plate 216 are fed into the area between a driving roller 218 and a guide roller 220, and the leader 46 fed out is further pulled out by the driving force of these rollers. A guide 226 is provided above the driving roller 218. The guide 226 extends obliquely upward. Accordingly, the leader 46 fed out from the area between the rollers 218, 220 is conveyed obliquely upward along the lower surface of the guide 226.

Adjacently to the rollers 218, 220, an accumulating plate 228 is connected to the frame 14 through a bracket 227. The accumulating plate 228 is disposed such as to face the leader 46 being fed out and such that the longitudinal axis thereof extends vertically. The upper end of the plate 228 is bent such as to form a stopper 230, while the lower end of the plate 228 is open. Further, the accumulating plate 228 is provided at an intermediate portion thereof with a hook 232 which projects obliquely upward such that a multiplicity of leaders 46 can be suspended from the hook 232. Below the accumulating plate 228, a box 234 is placed for receiving the respective lower ends of the films 38.

The film conveying mechanism 10 in accordance with this embodiment arranged as described above operates as follows.

First of all, the respective leading ends of two films 38 are pulled out of the associated film cassettes 40 and are secured to the trailing end of the leader 46, as shown in FIG. 2. Then, the cover 56 shown in FIG. 3 is opened, and the film cassettes 40 are set on the holder 60. Further, the leader 46 is mounted on the conveyor roller 67.

When the operator closes the cover 56 in this state, the leader 46 is held between the conveyor rollers 66, 67, and a portion of each cutter 68 fits into the corresponding guide groove 86.

Then, the operator presses a predermined start button. Thereupon, the conveyor rollers 66, 67 are rotated, whereby the leader 46, together with the films 38, is conveyed in the direction of the arrow A in FIG. 3.

When the films 38 have been completely unwound off the respective spools 44 of the film cassettes 40, the holder 60 and the film cassettes 40 are moved toward the cutters 68 against the biasing force of the compression coil spring 64. For this purpose, it is necessary to set the biasing force of the compression coil spring 64 to be smaller than the film pulling force of the conveyor rollers 66, 67.

When the holders 60 have been moved forwardly by a predetermined distance, the front surfaces thereof press the contactors 88A of the limit switches 88. In consequence, the solenoids 82 are actuated such as to instantaneously move the actuating pins 80 upwardly, whereby the cutters 68 cut off the respective trailing ends of the films 38 from the film cassettes 40 (the spools 44, precisely speaking) as shown in FIG. 4.

Since each cutter 68 has partially entered the corresponding guide groove 86 beforehand and the guide groove 86 has an enlarged opening, as it is actuated, the cutter 68 is allowed to reliably pivot along the guide groove 86. After cutting the films 38, the cutters 68 are returned to their initial positions by the biasing forces of the torsion coil springs 76. The film cassettes 40 and the holder 60 are also pushed back to their initial positions by the biasing force of the compression coil spring 64.

The leader 46 is fed out from the area between the conveyor rollers 66, 67 and is downwardly turned by the support bracket 196 and the rollers 198 and is then engaged by the timing belt 124 in the treating tank 20. More specifically, the engagement projections 130 of the timing belt 124 respectively enter the square bores 48 in the leader 46, whereby the leader 46 is retained between the timing belt 124 and the guide bar 146 and is downwardly dipped into the treating solution contained in the treating tank 20.

In the vicinity of the lower end of this treating tank 20, the leader 46 is disengaged from the engagement projections 130 of the timing belt 124 as the timing belt 124 is turned. The leader 46 is then turned through the turning guide means formed by the rollers 174 and the bracket 176 and is moved upwardly. The leader 46 thus turned is re-engaged with the engagement projection 130 of the portion of the timing belt 124 moving upwardly and is moved toward the upper end of the treating tank 20.

The films 38, which are moved by being pulled by the leader 46 as it moves in this way, are prevented from meandering by the limiting blocks 162 and the pawls 156 which project from the inner surface of the cover plate 148 after the leader 46 has passed thereover. The films 38 are, therefore, properly developed in an appropriate tensile state and without contacting any other elements in the treating tank 20. In particular, the meandering prevention pawls are disposed such as to correspond to each of the opposing side edges of a pair of films 38 in order to limit the widthwise movement of the films 38, which fact allows reliable meandering prevention.

Moreover, each of the rollers 174 in the treating tank 20 has an outer peripheral configuration such that the outside diameter of the roller 174 is smallest at its axial center and is gradually increased toward both axial ends. Therefore, when the films 38 are turned by the bracket 176, they have an extremely small area of contact with the bracket 176. There is, therefore, no possibility that any undesirable flaw may be formed in the treated surfaces of the films 38.

The leader 46, which has been subjected to the developing treatment in the treating tank 20 and moved to the upper end thereof, is disengaged from the timing belt 124 again since the timing belt 124 is turned by the sprocket wheel 116. The leader 46 is then inserted into the turning guide means formed by the support bracket 184 and the rollers 190, whereby the leader 46 is turned such as to move downwardly and is transferred to the film conveyor unit 100 in the treating tank 22.

In this case also, the films 38 come in contact with the rollers 190 with an advantageously small area of contact; therefore, no flaw is formed.

Thereafter, by being led by the movement of the leader 46, the films 38 are successively subjected to bleaching, fixing, rinsing and stabilization through such operations as dipping, turning, takeout and transfer, which are effected in each of the treating tanks 22, 24, 26, 28, 30. The films 38 are then transferred to the treating tank 32, in which they are subjected to a drying treatment. The dried films 38 are delivered to the film accumulating device 42.

When the leader 46 attached to the respective leading ends of the films 38 has been fed out from the roller 214, the leader 46 is held by the driving roller 218 and the guide roller 220 as shown in FIG. 12.

Figure 13:
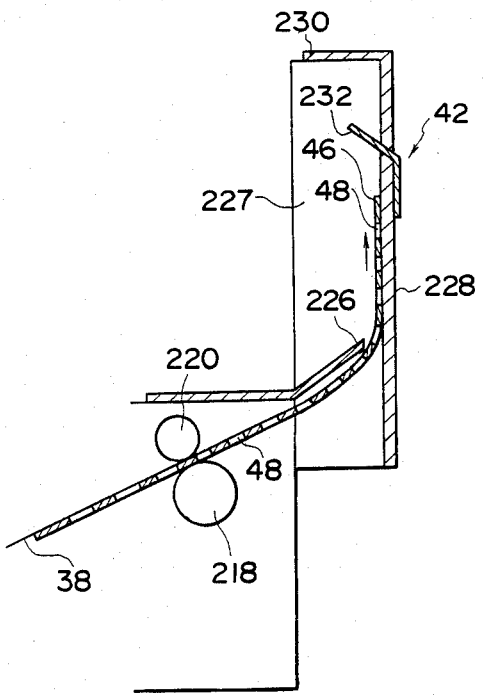
FIGS. 13 to 18 in combination show the operation of the film accumulating device shown in FIG. 12.

The leading end of the leader 46 advances along the lower surface of the guide 226 as shown in FIG. 13 and abuts against the inner surface of the accumulating plate 228 and is then turned upwardly. In the meantime, the trailing end of the leader 46 is still held between the driving roller 218 and the guide roller 220, and moreover, the leader 46 has flexibility. The leader 46 is, therefore, pushed up while abutting against the accumulating plate 228.

Figure 14:
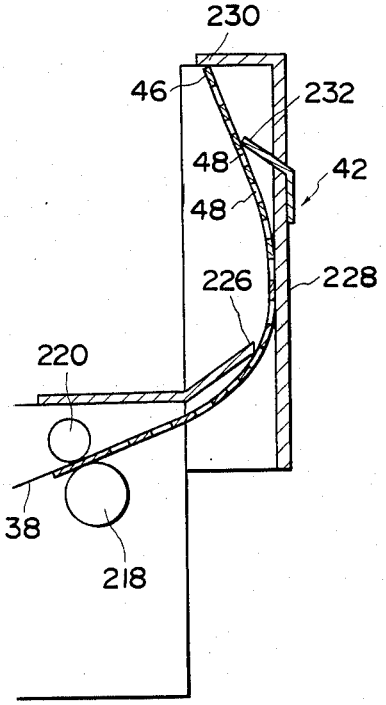

When the leading end of the leader 46 has reached the hook 232, as shown in FIG. 14, the leader 46 further advances upwardly while abutting against the distal end of the hook 232. The upward movement of the leader 46 is stopped when the leading end of the leader 46 abuts against the stopper 230. At this time, the trailing end of the leader 46 has already come out of the area between the driving roller 218 and the guide roller 220 and, therefore, the force for pushing up the leader 46 has almost disappeared.

Figure 15:
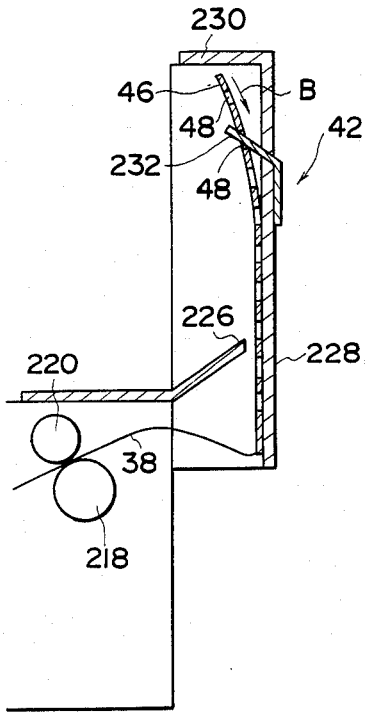

Accordingly, as the films 38 are further fed out from the area between the driving roller 218 and the guide roller 220, as shown in FIG. 15, the leader 46 moves in the direction of the arrow B by its own weight and restoring force. In consequence, one of the square bores 48 in the leader 46 engages the hook 232, and the leader 46 lowers until one side surface thereof comes in close contact with the inner surface of the accumulating plate 228.

Figure 16:
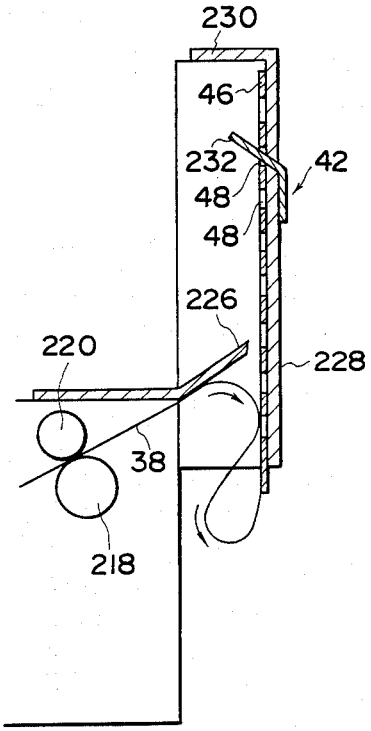
Figure 17:
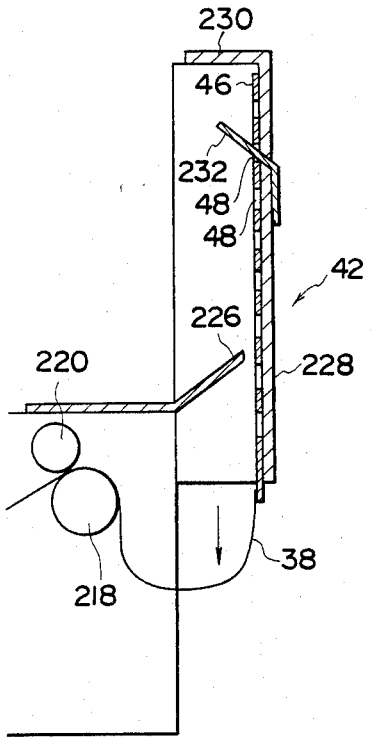
Figure 18:
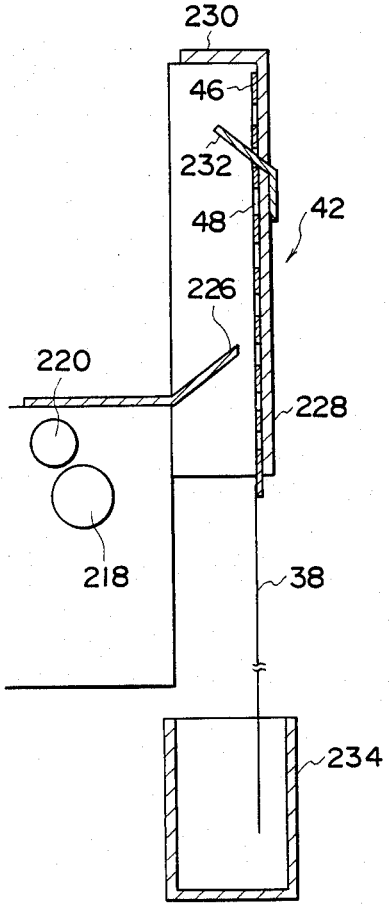
Figure 19:
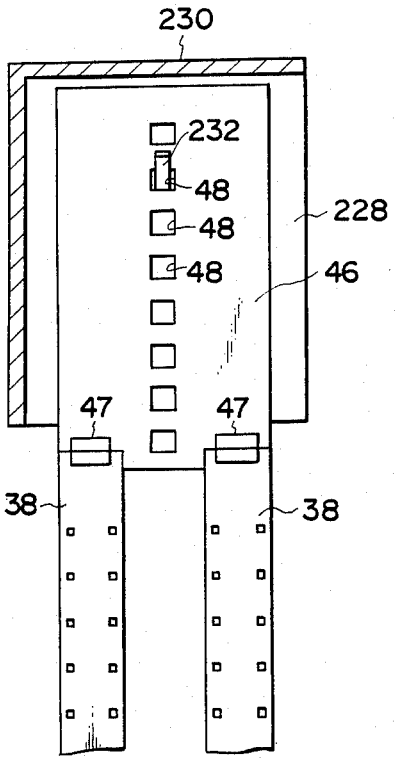
FIG. 19 is a front elevational view of the film accumulating device.

On the other hand, the films 38 fed out from the area between the rollers 218, 220 takes an inverted S shape below the guide 226 as shown in FIG. 16. As the films 38 are further fed out, as shown in FIG. 17, the films 38 are momentarily turned downwardly by virtue of their flexibility and their own weight. When the films 38 are further fed out and their respective trailing ends are fed out from the area between the rollers 218, 220, as shown in FIGS. 18 and 19, the leader 46 and the films 38 are suspended from the hook 232, and the respective trailing ends of the films 38 are deposited in the box 234.

It is to be noted that, if the leader 46 in the state shown in FIG. 14 is positioned such that a leading end portion thereof including two or more square bores 48 is located above the hook 232, then, when the leader 46 lowers as shown in FIG. 15, even if the second square bore 48 should fail to engage the hook 232, the first square bore 48 which is formed at the end portion of the leader 46 will reliably engage the hook 232. Further, in the case where developed films which have been subjected to the drying step are charged with frictional electricity, as shown in FIG. 12, a static charge eliminator 236 is provided below the outlet for the leader 46 fed out from the area between the rollers 218, 220, whereby any static charge can be eliminated from the developed films which are fed out successively. A subsequent leader is retained by the hook 232 in the order corresponding exactly to that described above. In this manner, a multiplicity of films are accumulated by the film accumulating device 42 in an aligned state. When a predetermined number of leaders, together with films, have been collected on the hook 232, the operator removes them simultaneously.

As has been described above, according to the film accumulating device 42 in accordance with this embodiment, it is possible to automatically suspend the films 38, together with the leaders 46, from the hook 232 successively in an aligned state. Further, as will be clear from FIG. 19, one of the sides (the right-hand side as viewed in the Figure) of the film accumulating device 42 is open and, therefore, it is advantageously possible for the operator to easily take out the films 38.

Furthermore, it is also advantageously possible to immediately observe the finished state of each of the films 38 in the suspended state without the need to take them out one by one. In addition, the provision of the static charge eliminator 236 (see FIG. 12) allows any static charge to be eliminated from the films 38 which are fed out successively, whereby it is also possible to prevent the adhesion of dust on the films 38.

What is claimed is:

1. A film accumulating device which is disposed at the rear of a film developing apparatus such as to accumulate developed films, comprising:

(a) driving means which pulls out from a developing line a leader attached to the leading end of a film;

(b) guide means which upwardly guides said leader being fed out by said driving means;

(c) a stopper which stops a portion of said leader near its leading end at a predetermined position, said leader being upwardly guided by said guide means; and (d) a hook disposed in the vicinity of said stopper such as to suspend said leader by engaging a bore formed in said leader, whereby the developed film is deposited while being suspended from said hook through said leader which is in engagement with said hook. .

2. A film accumulating device according to claim 1, wherein said guide means is a plate member which is disposed such as to cross the moving direction of said leader fed out by said driving means.

3. A film accumulating device according to claim 2, wherein said guide means is a plate member which is disposed substantially vertically.

4. A film accumulating device according to claim 1, further comprising a guide member disposed between said driving means and said guide means such as to extend toward said guide means along the advancing direction of said leader fed out by said driving means and above said leader so as to upwardly guide the leading end of said leader along said guide means.

5. A film accumulating device according to claim 1, wherein said stopper is provided on the upper end of said guide means at a position where said stopper abuts against the leading end of said leader moving upwardly.

6. A film accumulating device according to claim 1, wherein said hook is obliquely projected from a portion of said guide means toward said stopper.

7. A film accumulating device according to claim 1, wherein the spacing between said stopper and said hook is set such that said hook in a state wherein the upward movement of said leader is stopped by said stopper corresponds to the second bore, counted from the leading end of said leader, or any one thereafter of a plurality of bores formed in said leader in the longitudinal direction thereof, whereby, when said leader which has been stopped from moving upwardly lowers, said leader reliably engages with said hook.

8. A film accumulating device according to claim 1, wherein said stopper is disposed such that, when said leader is stopped by said stopper from moving upwardly, the trailing end of said leader is in the vicinity of said driving means, whereby, when said driving means has completely fed out the trailing end of said leader, the upwardly pushing force applied to said leader is decreased to allow said leader to lower in such a manner as to be suspended from said hook.

9. A film accumulating device according to claim 8, further comprising a guide member disposed between said driving means and said guide means above said leader fed out by said driving means such as to abut against said film upwardly fed out by said driving means subsequently to said leader so that a portion of said film is bent between said guide member and said leader and so that, when the length of the bent portion reaches a predetermined value, said guide member allows said bent portion to be inverted by the moving force of said film being further fed out and downwardly guides said film being fed out by said driving means.

10. A film accumulating device according to claim 1, wherein said guide means is a plate member which is disposed substantially vertically, and the upper end of this plate member is bent such as to form said stopper.

11. A film accumulating device according to claim 10, wherein said guide means and said stopper are supported by said developing apparatus through one of the sides of said device in the widthwise direction of the film to be suspended, and the other side is open for the purpose of taking out the suspended leaders and films.

12. A film accumulating device which is used together with a developing apparatus in which a thin-walled leader is connected to the leading end of a film, the leader having a plurality of bores formed in its advancing direction, which bores successively engage with feed means of said developing apparatus, thereby allowing said film to be subjected to a development treatment, comprising:

(a) guide means which upwardly guides said leader fed out from said developing apparatus;

(b) a stopper disposed at the upper end of said guide means such as to abut against the leading end portion of said leader, thereby stopping the upward movement of said leader;

(c) a hook disposed such as to abut against said leader which is being guided by said guide means toward said stopper from said guide means side; and (d) driving means which decreases or cancels the force for feeding out said leader after the leading end of said leader has abutted against said stopper, whereby said leader lowers in a direction in which it comes away from said stopper, and one of said bores formed in said leader engages with said hook, thus allowing said film successively fed out from said developing apparatus to be deposited while being suspended from said hook through said leader which is in engagement with said hook.

13. A film accumulating device according to claim 12, further comprising a guide member disposed between said driving means and said guide means such as to extend toward said guide means along the advancing direction of said leader fed out by said driving means and above said leader so as to upwardly guide the leading end of said leader along said guide means.

14. A film accumulating device according to claim 12, wherein said hook is obliquely projected from a portion of said guide means toward said stopper.

15. A film accumulating device according to claim 12, wherein the spacing between said stopper and said hook is set such that said hook in a state wherein the upward movement of said leader is stopped by said stopper corresponds to the second bore, counted from the leading end of said leader, or any one thereafter of a plurality of bores formed in said leader in the longitudinal direction thereof, whereby, when said leader which has been stopped from moving upwardly lowers, said leader reliably engages with said hook.

16. A film accumulating device according to claim 12, further comprising a guide member disposed between said driving means and said guide means above said leader fed out by said driving means such as to abut against said film upwardly fed out by said driving means subsequently to said leader so that a portion of said film is bent between said guide member and said leader and so that, when the length of the bent portion reaches a predetermined value, said guide member allows said bent portion to be inverted by the moving force of said film being further fed out and downwardly guides said film being fed out by said driving means.

17. A film accumulating device according to claim 12, wherein said guide means and said stopper are supported by said developing apparatus through one of the sides of said device in the widthwise direction of the film to be suspended, and the other side is open for the purpose of taking out the suspended leaders and films.

18. A film accumulating device which is connected to a developing apparatus in which a film is developed while being pulled by a thin-walled leader connected to the leading end of said film, said leader having a plurality of bores formed in its advancing direction, comprising:

(a) a pair of rollers which feed out said leader from said developing apparatus in an obliquely upward direction;

(b) a guide plate disposed vertically such as to face said leader being fed out by said rollers;

(c) a stopper disposed at the upper end of said guide plate such as to abut against the leading end of said leader, thereby stopping the upward movement of said leader; and (d) a hook disposed at an upper portion of said guide plate which is below said stopper and within the locus of the upward movement of said leader, said hook upwardly projecting toward the bores in said leader moving upwardly, whereby, when said leader lowers after the raising force applied by said rollers has decreased or disappeared, said leader is retained by said hook through one of said bores, thus allowing said film successively being fed out to be suspended from said hook through said leader.

19. A film accumulating device according to claim 18, wherein the spacing between said stopper and said hook is set such that said hook in a state wherein the upward movement of said leader is stopped by said stopper corresponds to the second bore, counted from the leading end of said leader, or any one thereafter of a plurality of bores formed in said leader in the longitudinal direction thereof, whereby, when said leader which has been stopped from moving upwardly lowers, said leader reliably engages with said hook.

20. A film accumulating device according to claim 18, further comprising a guide member disposed between said driving means and said guide means above said leader fed out by said driving means such as to abut against said film upwardly fed out by said driving means subsequently to said leader so that a portion of said film is bent between said guide member and said leader and so that, when the length of the bent portion reaches a predetermined value, said guide member allows said bent portion to be inverted by the moving force of said film being further fed out and downwardly guides said film being fed out by said driving means.

21. A film accumulating device according to claim 18, wherein said guide means and said stopper are supported by said developing apparatus through one of the sides of said device in the widthwise direction of the film to be suspended, and the other side is open for the purpose of taking out the suspended leaders and films.

* * * * *